United States Patent [19]

Weghorn

[11] 3,996,873

[45] Dec. 14, 1976

[54] HALYARD CLIP

[76] Inventor: Charles August Weghorn, 360 Vallejo, Apt. 89, Millbrae, Calif. 94030

[22] Filed: Apr. 14, 1975

[21] Appl. No.: 567,474

[52] U.S. Cl. ..... 114/108

[51] Int. Cl.[2] ..... B63H 9/04

[58] Field of Search ..... 114/101–115, 114/218, 39; 24/115, 128 R, 129 R, 130, 116 R, 116 A; 116/173–174; D8/229–233; 24/116 R, 116 A; 403/353 R

[56] References Cited

UNITED STATES PATENTS

| | | | |
|---|---|---|---|
| 179,172 | 6/1876 | Eager | 24/128 |
| 382,957 | 5/1888 | English | 24/115 D |
| 1,453,426 | 5/1923 | Williams | 114/101 |
| 2,925,798 | 2/1960 | Colgate | 114/102 |
| 3,343,514 | 9/1967 | Brett | 114/108 |
| 3,507,243 | 4/1970 | Brown | 114/218 |

FOREIGN PATENTS OR APPLICATIONS

| | | | |
|---|---|---|---|
| 489,875 | 8/1938 | United Kingdom | 114/102 |

*Primary Examiner*—Trygve M. Blix
*Assistant Examiner*—Jesus D. Sotelo
*Attorney, Agent, or Firm*—Henry G. Kohlmann

[57] ABSTRACT

A halyard clip is disclosed which may be readily employed in the rigging of sailboats. More particular the halyard clip is a generally L shaped device attached to the mast for securing the halyards of sailboats in a fixed position, thereby allowing the winches used to raise the sails to be used for other purposes.

4 Claims, 6 Drawing Figures

HALYARD CLIP

BACKGROUND OF THE INVENTION

1. Field of the Invention

This invention generally relates to devices that may be employed to secure the halyards of sailing vessels when the sails have been raised into proper position. More specifically, the present invention concerns a halyard clip that secures the halyard in the same predetermined fixed position relative to the mast each time the sail is raised.

2. Description of the Prior Art

Sailing vessels ordinarily provide for the raising and lowering of sails by a rigging comprising a halyard connected to the headboards of said sails which halyard passes over pulleys or similar devices in the mast above the sail and thence passes downward either on the opposite side of the mast or down the same side depending on the particular pulley arrangement to a winch located at the bottom of the mast.

Proper positioning of the sail requires that either the halyard remain attached to the winch and the winch be by some means held in a fixed position or that a line be used to tie down the halyard before it is disconnected therefrom. Since the halyard is normally a steel cable the tie down is accomplished by use of a rope made of nylon or some other flexible material.

Such methods of securing the halyards suffer from several disadvantages. Where the winch is used as a means for securing the halyard, that is holding it in a fixed position relative to the mast, the winch must be of sufficient size and strength to hold the sail not only against its own weight but against all the wind forces thereon which forces can range as high as 350 pounds. Not only does this require a stronger and more expensive winch but the winch cannot be used for any other purpose. Where the tie down method is used, the flexible nature of the tie down line also allows the line to stretch with changing forces, thus changing the position of the sail. This is particularly critical in the case of racing sailboats where the sail must be positioned between the black bands which mark the proper set or the vessel can be disqualified. In addition this method is not practical where rapid sail changes must be made.

An object of the present invention is to reduce the size, cost and complexity of the winches used for raising and lowering sails on sailboats.

Another object is to reduce the number of winches required on sailboats by making those used on the halyards available for other purposes when the sails are set.

Still another object is to provide a simplified means of rapidly securing the halyards in a fixed position relative to the mast even under conditions of turbulent seas or while the vessel is underway while insuring that the halyard, and hence, the sail is set in precisely the same position each time.

Still another object is to provide a simplified structure for securing the halyard which will not foul or fail under the corrosive conditions of the weather.

The prior art further teaches the use of halyard clips or securing devices as typified by the patent issued to H. E. Britt, U.S. Pat. No. 3,343,514. However, there are several attendant disadvantages in the Britt device in that when in use care must be exercised so that the stop cable is not raised too high causing either failure to properly engage and sliding back down through the return channel or cause the stop to become snagged in the pulley arrangement thus, making it impossible to get the sail down without climbing up the mast. In either case not being able to get the sail up and secured or down rapidly can result in a dangerous situation and loss of control of the vessel.

Further, the Britt device is difficult to install because it is at the top of the mast, not at eye level as the present invention.

Finally, the Britt device causes the cable to bend at the point where the stop is attached. This is a source of fatigue and possible point of failure of the cable due to flexing of the cable against the ridgedly attached stop.

The present halyard clip avoids these disadvantages in that such care need not be exercised in raising the sail and the halyard may be secured when the loop therein is at any point below the notch in the clip. The clip is easily installed while standing on the deck and finally the clip holds the cable in such a manner as to avoid points of stress or fatigue and without causing burrs on the cable.

Figure 3:
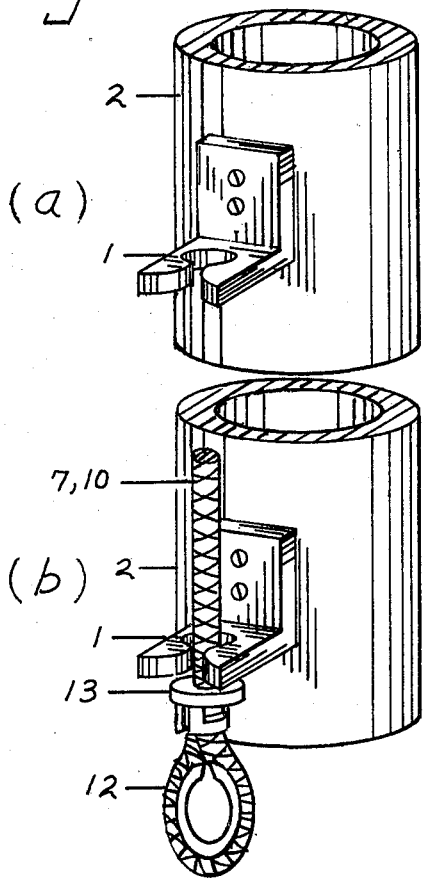

FIG. 3*a* is a sectional view of the mast, showing the halyard clip secured in place. The opposite sail rail is omitted for clarity.

FIG. 3*b* is the same view as in 3*a* except that the halyard is shown in its secured position.

FIG. 4*a* is a top view of the halyard clip.

FIG. 4*b* is a frontal view of the halyard clip.

Figure 1:
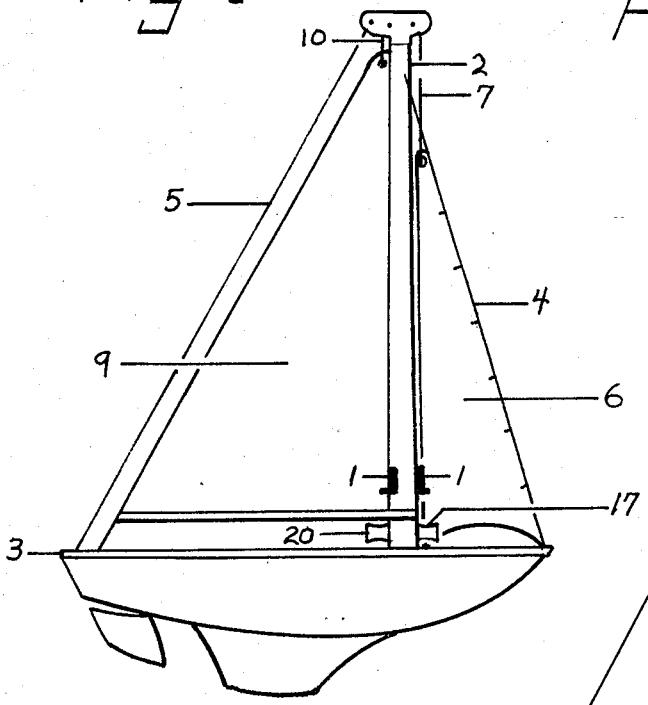
FIG. 1 is a view of a sailboat with the halyard clip attached for both the mainsail and the jibsail halyards.

FIG. 1 shows a sailboat with the halyard clips 1 installed on the mast 2. The mast 2 is attached to a deck 3 and held in place by a forward cable 4, called a forestay, and an after cable 5, called a backstay. Cables at the sides of the vessel further anchor the mast and are called shrouds. The shrouds are not shown to avoid confusion.

Figure 2:
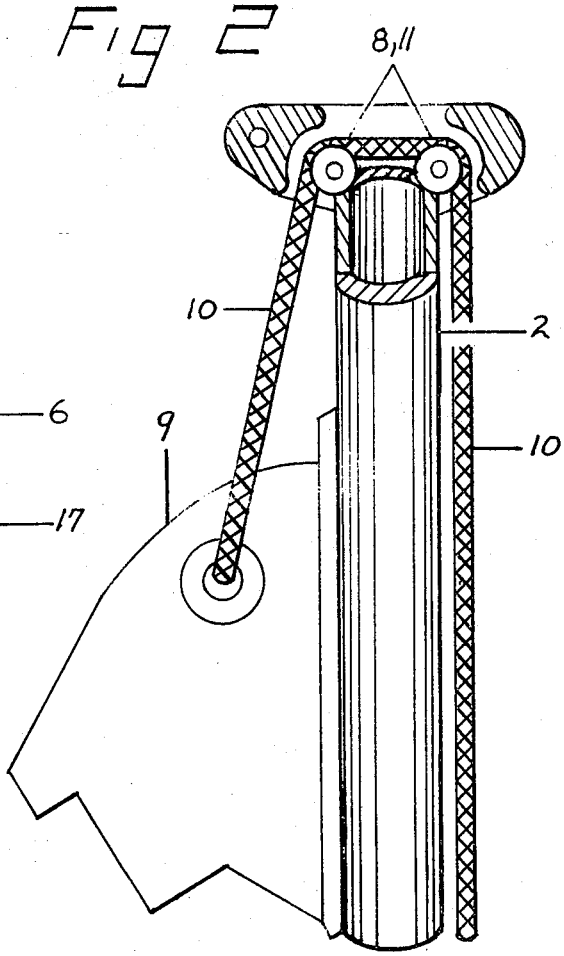
FIG. 2 is a detailed view of the pulley arrangement at the top of the mast.

Between the forestay 4 and the mast 2 is the jibsail 6. The jibsail 6 is slideably attached, bent, to the forestay. The jibsail 6 is raised by a halyard 7 attached to the top thereof and which halyard passes upward over pulley 8 located at the top of mast 2 thence downward and is removably attached to a pulley 17. Between the backstay and mast 2 is the mainsail 9. The mainsail 9 is raised by a halyard 10 attached to the top thereof and which halyard passes upward over pulleys 11 located at the top of mast 2 thence downward and is removably attached to a pulley 20 shown in greater detail in FIG. 2. The jibsail halyard as well as the stays have been omitted from FIG. 2 for clarity. Both halyards 7 and 10 are normally made of steel cable and each has a loop 12 at the bottom thereof as shown in FIG. 3*b*. Because the loop 12 is formed by bending back a steel cable it is held in place by a pressed on metal fitting 13.

It is this metal fitting 13 that enables the halyard clip to hold said halyards 7 and 10 in a fixed position.

Figure 4:
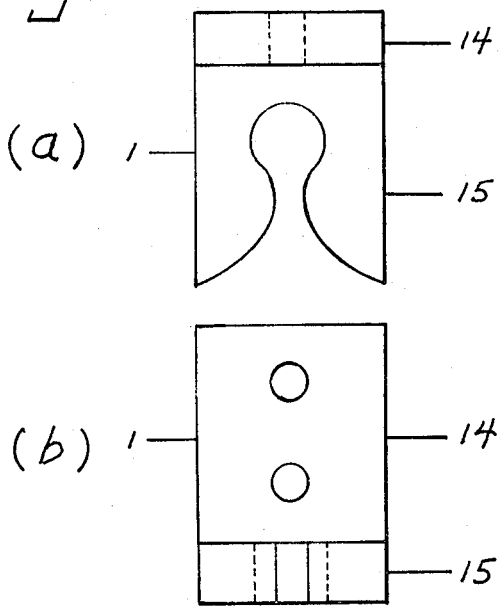

The halyard clip 1 is shown in FIG. 4 as an L shaped member the vertical portion 14 having screw holes for attaching said clip to the mast 2 and the horizontal portion 15 being a bifurcated member.

Said bifurcations forming a generally keyhole shaped slot being spaced further apart at the open end than the diameter of the halyard 7 or 10. Laterally from the open end the bifurcations are spaced apart a distance equal to the diameter of the halyard 7 or 10. At the point where the bifurcations join they form a circle of a diameter greater than that of the halyard 7 or 10 but smaller than the diameter of the metal fitting 13.

Thus, when the sail is raised to a position where the loop 12 is below the halyard clip the halyard may be snapped into the clip and the sail then lowered. When the metal fitting 13 comes in contact with the clip 1, the sail will be held in position and the halyard 7 or 10 will be held in a fixed position relative to the mast 2, as shown in FIG. 3*b*. Said position will be the same each time the sail is set without regard to the distance the loop 12 travels below the halyard clip nor at which point the halyard 7 or 10 is snapped into the halyard clip.

Since the bifurcations are spaced a distance greater than the diameter of the halyard 7 or 10 at the open end great care need not be exercised in inserting said halyard 7 or 10 into said clip 1 and said halyard 7 or 10 may be "snapped in" even in rough seas.

The motion of snapping in the cable and movement thereof in an axial direction through the circular portion of the bifurcations when setting the sail continually cleans the clip and keeps it free of dirt and other materials.

Further, use of this invention is not limited to halyards on the mast but the clip may be used in any position so long as the cable which is to be held can travel axially of the circular portion of the bifurcations.

What is claimed is:

1. A halyard clip for releasably securing a fitting on a loop of a halyard in a fixed position relative to the mast of a sailboat comprising:

a. A horizontal member having a generally keyhold shaped slot for receiving the halyard, said hole being of sufficient size to allow the halyard to pass through freely but not allowing the fitting on the loop of the halyard to enter said keyhole shaped slot;

b. a vertical member fixedly attached at the end of said horizontal member opposite said keyhole shaped slot having means for fixedly attaching said vertical member to the mast, whereby said halyard clip forms a generally L shaped member attached to the mast, and whereby said halyard passes freely through said hole without touching the sides thereof thus preventing stress and the creation of burrs on said halyard.

2. A halyard clip for releasably securing a fitting on a loop of a halyard in a fixed position relative to the mast of a sailboat comprising:

a. a horizontal member having a hole open at one end for receiving the halyard; said hole being of sufficient size to allow the halyard to pass through freely but preventing the fitting on the loop of the halyard to enter said hole, b. a vertical member fixedly attached on the side opposite the open end of said hole of the horizontal member having means for fixedly attaching said vertical member to the mast, whereby said halyard clip forms a generally L shaped member attached to the mast, and whereby said halyard passes freely through said hole without touching the sides thereof thus preventing stress and the creation of burrs on said halyard.

3. A halyard clip as described in claim 2 wherein said hole in said horizontal member is circular and of a size sufficient to allow free passage of the halyard axially of the hole and said circular hole being open at the end opposite the vertical member and having a gradually greater opening away from the circular portion so as to deflect the halyard toward the circular portion when said halyard is pressed against said halyard clip.

4. A halyard clip for releasably securing a fitting on a loop of a halyard in a fixed position relative to the mast of a sailboard comprising:

a. a vertical member having means for securing said clip to said mast, b. a bifurcated member depending horizontally from said vertical member, which bifurcations are spaced apart at the open end a distance greater than the diameter of said halyard at a point laterally removed from the open end, a distance equal to the diameter of said halyard; and at the point where said bifurcations join they form a circle of a diameter greater than that of said halyard but smaller than the diameter of said fitting, whereby said halyard is received by said bifurcated member and prevents said fitting from passing into said member and whereby said halyard passes freely through the circular portion of said clip without touching the sides thereof thus preventing stress and the creation of burrs on said halyard.

* * * * *